US009587483B2

(12) United States Patent
Ramirez et al.

(10) Patent No.: US 9,587,483 B2
(45) Date of Patent: Mar. 7, 2017

(54) LANDFILL WELL LIQUID LEVEL CONTROL PUMP

(71) Applicant: Q.E.D. ENVIRONMENTAL SYSTEMS, INC., Dexter, MI (US)

(72) Inventors: Antonio U. Ramirez, San Francisco, CA (US); David D. Simpson, Discovery Bay, CA (US)

(73) Assignee: Q.E.D. Environmental Systems, Inc., Dexter, MI (US)

( * ) Notice: Subject to any disclaimer, the term of this patent is extended or adjusted under 35 U.S.C. 154(b) by 0 days.

(21) Appl. No.: 15/117,584

(22) PCT Filed: Feb. 16, 2015

(86) PCT No.: PCT/US2015/016040

§ 371 (c)(1),
(2) Date: Aug. 9, 2016

(87) PCT Pub. No.: WO2015/123633

PCT Pub. Date: Aug. 20, 2015

(65) Prior Publication Data

US 2016/0356134 A1 Dec. 8, 2016

Related U.S. Application Data

(60) Provisional application No. 61/940,691, filed on Feb. 17, 2014, provisional application No. 62/045,218, filed on Sep. 3, 2014.

(51) Int. Cl.

| | |
|---|---|
| ***E21B 47/04*** | (2012.01) |
| ***E21B 43/12*** | (2006.01) |
| ***F04F 1/08*** | (2006.01) |

(52) U.S. Cl.
CPC ..... *E21B 47/042* (2013.01); *E21B 43/121* (2013.01); *F04F 1/08* (2013.01)

(58) Field of Classification Search
CPC ..... E21B 47/042; F04F 1/08
See application file for complete search history.

(56) References Cited

U.S. PATENT DOCUMENTS 3,965,983 A 6/1976 Watson
4,249,598 A * 2/1981 Greer ..... E21B 34/16 116/228

(Continued)

OTHER PUBLICATIONS

International Search Report for PCT/US2015/016040, ISA/KR, Daejeon, mailed May 19, 2015.

(Continued)

*Primary Examiner* — Shane Bomar
(74) *Attorney, Agent, or Firm* — Harness, Dickey & Pierce, P.L.C.

(57) ABSTRACT

A liquid level control pump especially well adapted for use in landfill wells is disclosed. The pump makes use of a pump casing, a discharge tube, a control rod, first and second check valves, a float and a pivoting lever assembly for controlling the application of a pressurized fluid from an external pressurized fluid source. In one aspect the float may include a through slot which allows the control rod to pass therethrough and which helps to reduce the chance of the float hanging due to an accumulation of solids between the control rod and the float. In another aspect a removable and replaceable discharge tube sleeve may be included.

20 Claims, 14 Drawing Sheets

(56) References Cited

U.S. PATENT DOCUMENTS

| | | | | | |
|---|---|---|---|---|---|
| 4,663,037 | A * | 5/1987 | Breslin | B01D 17/0214 | 166/90.1 |
| 5,373,897 | A * | 12/1994 | Skarvan | E21B 43/121 | 166/250.03 |
| 5,819,849 | A | 10/1998 | Booth | | |
| 5,944,490 | A * | 8/1999 | Breslin | F04F 1/08 | 417/131 |
| 6,045,336 | A * | 4/2000 | Webb | B01D 17/0214 | 137/393 |
| 6,146,104 | A * | 11/2000 | Mastroianni | B09C 1/002 | 166/370 |
| 7,316,542 | B2 | 1/2008 | Mills | | |
| 2006/0067834 | A1 | 3/2006 | Boyer et al. | | |
| 2010/0101774 | A1 | 4/2010 | Ocondi et al. | | |
| 2016/0290111 | A1 * | 10/2016 | Patel | E21B 37/06 | |

OTHER PUBLICATIONS

Written Opinion of the ISA for PCT/US2015/016040, ISA/KR, Daejeon, mailed May 19, 2015.

* cited by examiner

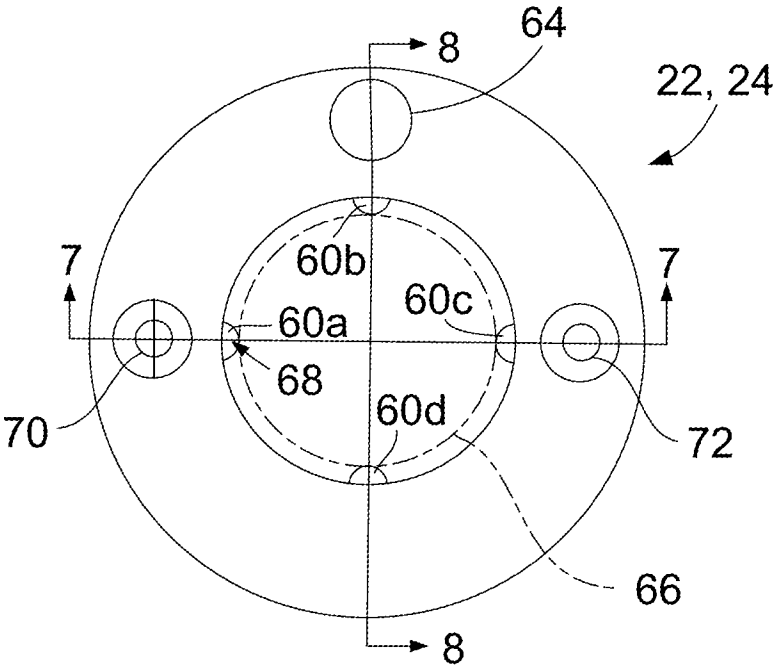
Fig. 6
Fig. 5
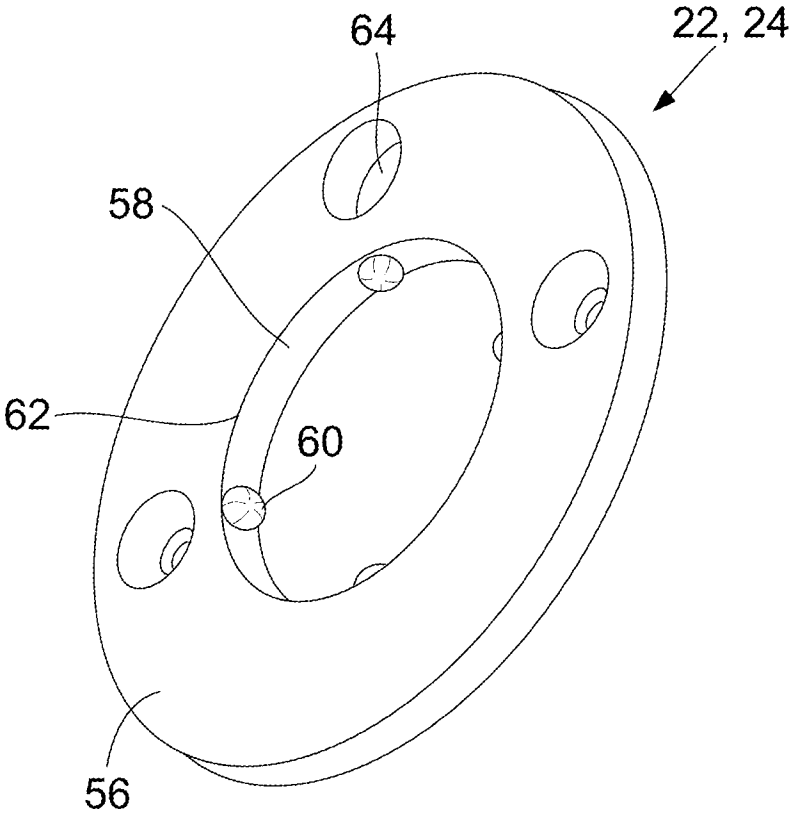

Fig. 8
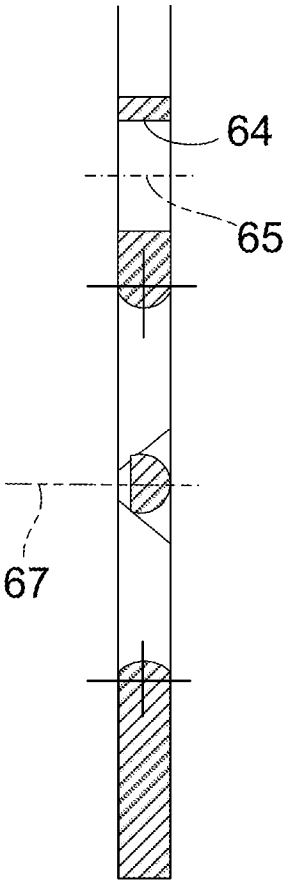
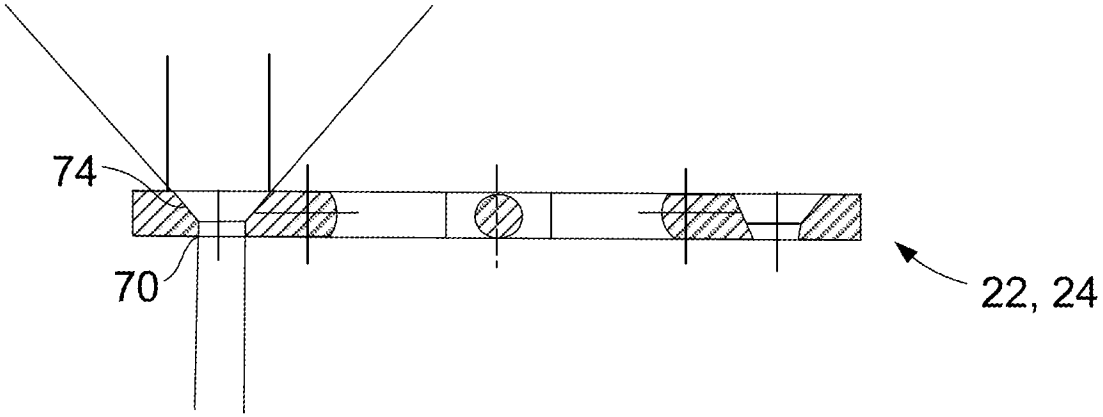
Fig. 7

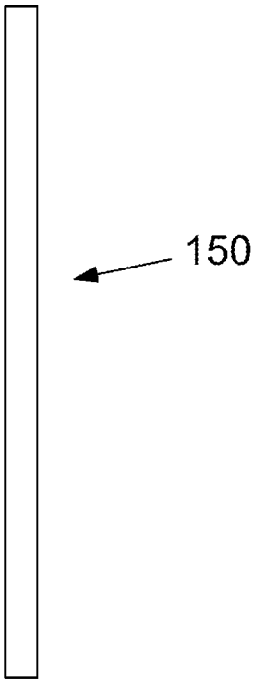
Fig. 20
Fig. 21
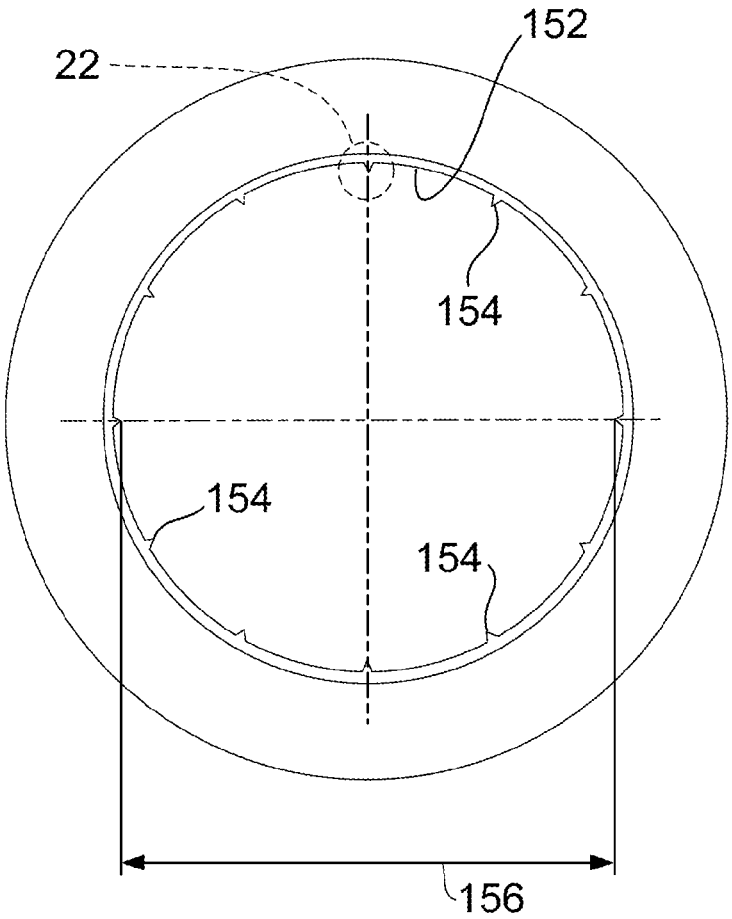
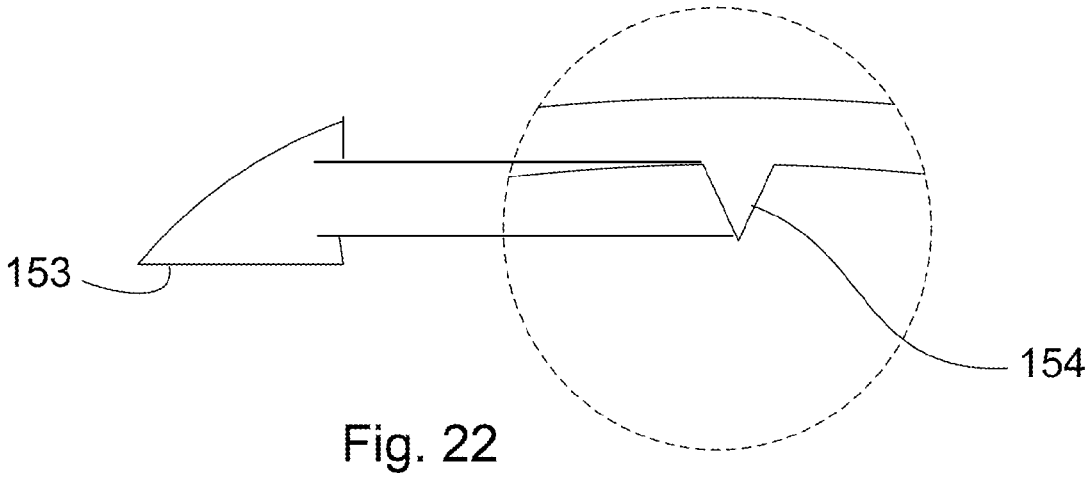
Fig. 22

LANDFILL WELL LIQUID LEVEL CONTROL PUMP

CROSS-REFERENCE TO RELATED APPLICATIONS

The present application is a 371 National Phase of International Application PCT/US2015/016040, filed on Feb. 16, 2015, which claims priority from U.S. Provisional Application Ser. No. 62/045,218 filed on Sep. 3, 2014, and U.S. Provisional Application Ser. No. 61/940,691, filed Feb. 17, 2014. The entire disclosures of each of the above applications are incorporated herein by reference.

FIELD

The present disclosure relates to submersible pumps used in landfill wells for leachate discharge and well liquid level control, and more particularly to a pneumatically driven, automatic pump that is especially resistant to the buildup contaminants on its moving components.

BACKGROUND

This section provides background information related to the present disclosure which is not necessarily prior art.

Present landfill leachate and liquid level control pumps typically have metal end plates with four protrusions on the ID on both ends of the pump float to reduce the contact area and thereby reduce stiction forces hindering free movement of the float. Abrasion of the discharge tube surface from the pump float can lead to corrosion and pitting of the discharge tube which in turn can aid in solids adhesion, which increases stiction forces. Stiction is defined as a static friction that must be overcome to enable relative motion of stationary objects initially in contact with each other. Field reports from landfill well sites describe a downward spiral in the discharge tube surface roughness leads to increased susceptibility to corrosion and greater solids adhesion rate and cleaning difficulty. The present rough surface is also an industry standard pipe manufacturing quality, which includes surface pitting.

Known pump air control mechanisms include stainless steel "E" clips. The "E" clips' thinness, which is a corrosive attack factor, and susceptibility to subtle damage in disassembly have caused problems requiring replacement in the field.

SUMMARY

This section provides a general summary of the disclosure, and is not a comprehensive disclosure of its full scope or all of its features.

In one aspect the present disclosure relates to a liquid level control pump adapted to be lowered into contact with a fluid collecting with a wellbore, and being in communication with an external pressurized fluid source. The liquid level control pump may comprise a pump casing, a discharge tube, a first check valve, a second check valve, a float, a control rod, and a pivoting lever assembly. The discharge tube is disposed substantially within the pump casing and has a first end and a second end. The discharge tube is operable to receive fluid collecting within an area between the pump casing and an outer surface of the discharge tube. The discharge tube further includes first and second ends. The first check valve is disposed at the first end for controlling a flow of the fluid within the discharge tube to one direction only, that being out from the first end of the discharge tube. The second check valve is disposed at the second end for limiting the flow of fluid to one direction only, that being from the pump casing into the discharge tube at the second end. The source of pressurized fluid is in communication with the pump casing, and the float is arranged coaxially around the discharge tube and movable along the discharge tube towards the first and second ends. The control rod is disposed adjacent the discharge tube and operably associated with the float so as to be lifted by the float as the float moves toward the first end as the area within the pump casing fills with the fluid. The float moves towards the second end as the fluid within the pump casing is pumped out through the discharge tube using a pressurized fluid from the pressurized fluid source. The pivoting lever assembly is operably associated with the float for controlling the application and interruption of the pressurized fluid into the pump casing, to thus control the pumping of the fluid collecting within the pump casing out from the pump casing and into the second end of the discharge tube, towards the first end of the discharge tube. The float includes a through bore and a through slot in communication with the through bore. The through slot permits passage of a portion of the control rod therethrough and operates to permit fluid flow about an entire periphery of the control rod as the float moves up and down adjacent an outer surface of the discharge tube, and relative to the control rod. This reduces or eliminates a buildup of solids between the control rod and the float that could otherwise affect free sliding movement of the float along the discharge tube.

In another aspect the present disclosure relates to a liquid level control pump adapted to be lowered into contact with a fluid collecting with a wellbore, and being in communication with an external pressurized fluid source. The liquid level control pump comprises a pump casing, a discharge tube, a first check valve, a second check valve, a control rod, a float, a pivoting lever assembly, and a removable and replaceable discharge tube sleeve. The discharge tube is disposed substantially within the pump casing and has a first end and a second end. The discharge tube is operable to receive fluid collecting within an area between the pump casing and an outer surface of the discharge tube. The discharge tube further includes first and second ends. The first check valve is disposed at the first end for controlling a flow of the fluid within the discharge tube to one direction only, that being out from the first end of the discharge tube. The second check valve is disposed at the second end for limiting the flow of fluid to one direction only, that being from the pump casing into the discharge tube at the second end. The source of pressurized fluid is in communication with the pump casing, and the float is arranged coaxially around the discharge tube and movable parallel to the discharge tube towards and away from the first and second ends. The control rod is disposed adjacent the discharge tube and operably associated with the float so as to be lifted by the float as the float moves toward the first end as the area within the pump casing fills with the fluid. The float then moves towards the second end as the fluid within the pump casing is pumped out through the discharge tube using a pressurized fluid from the pressurized fluid source. The pivoting lever assembly is operably associated with the float for controlling the application and interruption of the pressurized fluid into the pump casing, to thus control the pumping of the fluid collecting within the pump casing out from the pump casing and into the second end of the discharge tube, towards the first end of the discharge tube. The removable and replaceable discharge tube sleeve is disposed over the outer surface of the discharge tube. The float is adapted to move slidably along an outer surface of the discharge tube sleeve.

DRAWINGS

The drawings described herein are for illustrative purposes only of selected embodiments and not all possible implementations, and are not intended to limit the scope of the present disclosure.

FIG. 5 is a perspective view of a pump end cap of the liquid level control pump of FIG. 1;

FIG. 6 is a front elevational view of the pump end cap of FIG. 5;

FIG. 7 is a cross sectional view taken at section 7 of FIG. 6;

FIG. 8 is a cross sectional view taken at section 8 of FIG. 6;

FIG. 20 is an elevational view of a replaceable discharge tube sleeve that may be incorporated into the pump of FIG. 1 by being placed over the discharge tube;

FIG. 21 is an end view of the sleeve shown in FIG. 20 illustrating a plurality of teeth or ridges that may be formed on the inner surface of the sleeve to eliminate play between the sleeve and the discharge tube;

FIG. 22 is an enlarged portion of the sleeve of FIG. 21 showing one example of the shape that the ridges may have, in this example the shape being generally triangular;

Corresponding reference numerals indicate corresponding parts throughout the several views of the drawings.

DETAILED DESCRIPTION

Example embodiments will now be described more fully with reference to the accompanying drawings.

Figure 1:
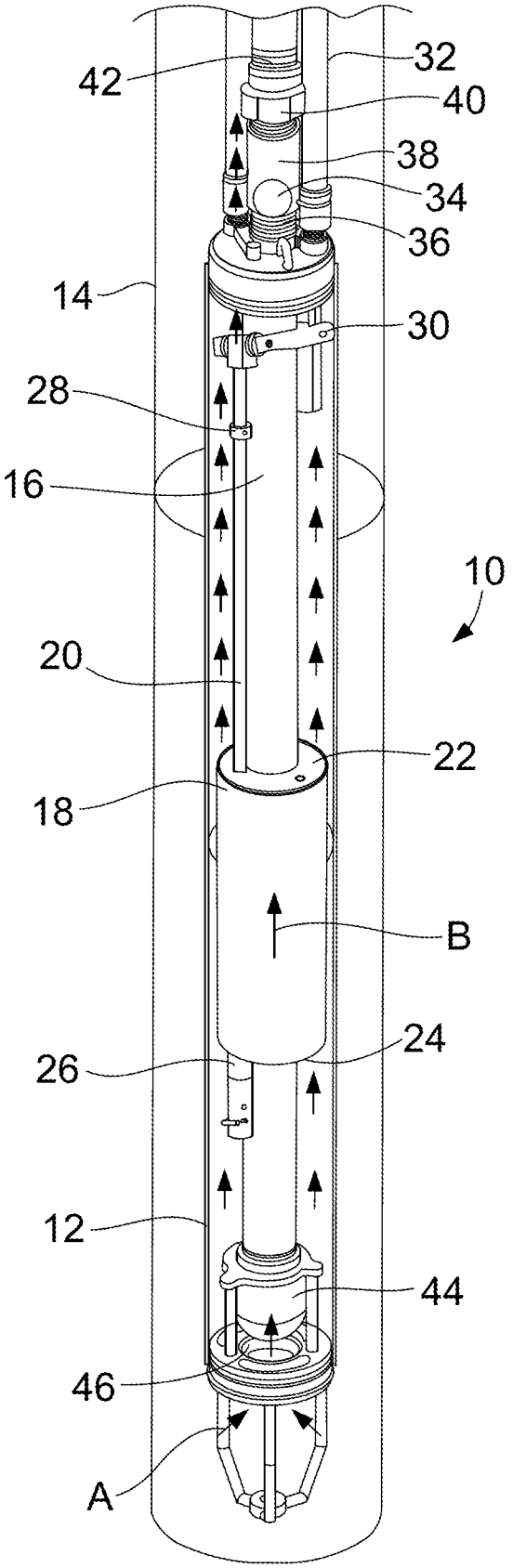
FIG. 1 is a partial cross sectional view of a liquid level control pump of the present disclosure positioned in a landfill well at a float lower position.

Referring to FIG. 1, a liquid level control pump 10 of the present disclosure includes a pump casing 12 which is submerged below an anticipated water level found in a landfill well pipe 14. Within the pump casing 12 is a discharge tube 16 centrally located in the pump casing 12. A float 18 is slidably disposed on the outer surface of the discharge tube 16 and can raise and lower as the water level within the landfill well pipe 14 changes. A control rod 20, positioned external to the discharge tube 16, is slidably received through the float 18 through each of a first float end cap 22 and a second float end cap 24 positioned at opposite ends of float 18.

After operation of the liquid level control pump 10, liquid level in the landfill well pipe 14 lowers and the float 18 is positioned in direct contact with a lower float stop 26 fixed to the control rod 20. Contact between the float 18 and the lower float stop 26 thereafter pulls the control rod 20 downward. An upper float stop 28 is also fixed to an upper location of control rod 20, whose function will be described in greater detail in reference to FIG. 2. A pivoting lever assembly 30 is connected to the control rod 20, whose position is changed by contact between float 18 and either the lower float stop 26 (as shown) or the upper float stop 28. At the lower position of float 18 (shown), the pivoting lever assembly 30 is rotated to an orientation which isolates pressurized air in a pressurized air supply tube 32 from entering pump casing 12. At this lower position of float 18, a ball 34 defining a portion of a ball check valve is seated against a threaded end 36 of a check valve ball housing 38. This seated position of ball 34 prevents fluid which has been discharged by operation of liquid level control pump 10 from returning back down into landfill well pipe 14. A housing adapter 40 is connected to the check valve ball housing 38 and is used to both retain the ball 34 within check valve ball housing 38 and as an adapter for connection to a tubing connector 42, where fluid discharged by operation of liquid level control pump 10 exits the pump.

In the lower position of float 18 (shown), fluid which enters the landfill well pipe 14 flows upward into the pump casing 12 by displacement of a check valve member 44 positioned at a lower end of liquid level control pump 10. The check valve member 44 displaces away from a valve seat 46, allowing the inward flow in the direction of flow arrows "A" into pump casing 12. This inward flow of fluid into pump casing 12 causes the float 18 to upwardly displace in a float upward displacement direction "B". This upward displacement of float 18 continues until the first float end cap 22 directly contacts the upper float stop 28 and displaces the control rod 20 upward to rotate the pivoting lever assembly 30.

Figure 2:
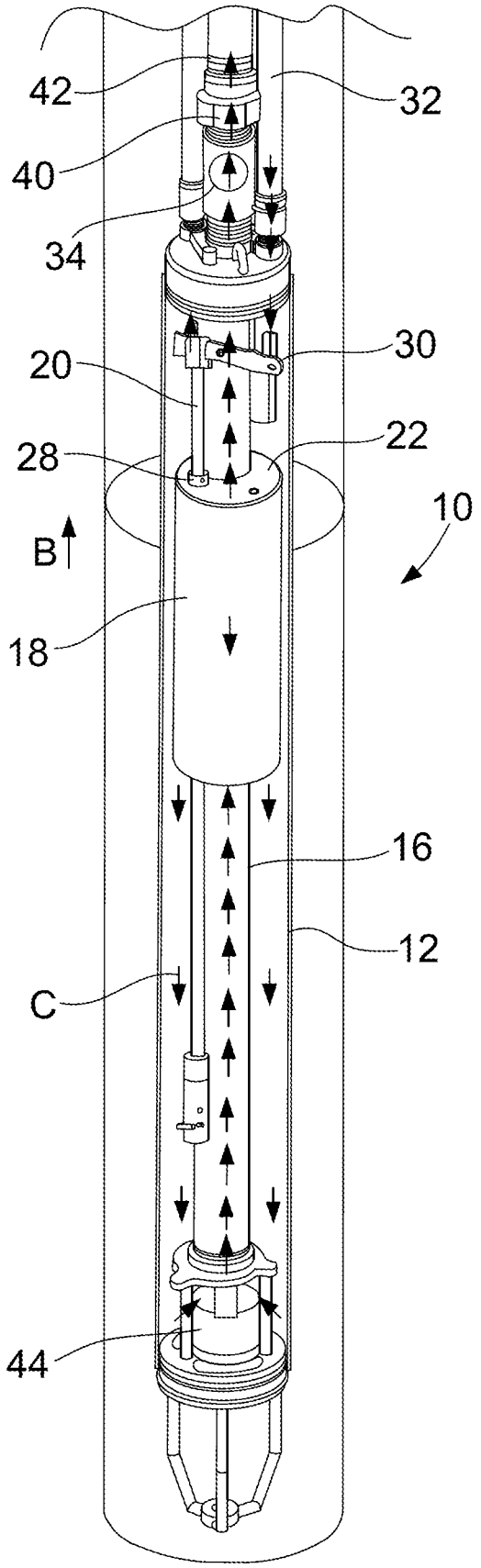
FIG. 2 is a partial cross sectional view of the pump of FIG. 1 at a float upper position.

Referring to FIG. 2, at the upward displacement position of float 18, the first float end cap 22 directly contacts upper float stop 28. After this direct contact occurs with upper float stop 28, further upward displacement of the float 18 causes the direct displacement of control rod 20 in the upward displacement direction "B", which rotates the pivoting lever assembly 30 to an opposite orientation from that disclosed with respect to FIG. 1. This rotation of pivoting lever assembly 30 displaces a poppet, described in reference to FIG. 9, which allows entrance of pressurized air from pressurized air supply tube 32 into the pump casing 12. The entrance of pressurized air into pump casing 12 forces the liquid within pump casing 12 to close the check valve member 44 and thereby open an entrance path for liquid to flow into the discharge tube 16, thereafter rising up through discharge tube 16 to upwardly displace the ball 34, providing a discharge path for liquid through housing adapter 40 and tubing connector 42 via a discharge pipe (not shown) for discharge of the liquid out of the landfill well pipe 14. Air flow into pump casing 12 continues until the position of float 18 shown in reference to FIG. 1 is reached again, which thereby rotates the pivoting lever assembly 30, isolating the pressurized air in pressurized air supply tube 32 from pump casing 12. This cyclic operation of liquid level control pump 10 continues as long as the fluid level within landfill well pipe 14 is sufficient to raise float 18 into direct contact with upper float stop 28 and as long as pressurized air is available in pressurized air supply tube 32. Improvements made to the liquid level control pump 10 include design changes which will be described herein with respect to the clearance provided for displacement of float 18 with respect to control rod 20, modifications to the pivoting lever assembly 30, and provision of the modified design of housing adapter 40.

Figure 3:
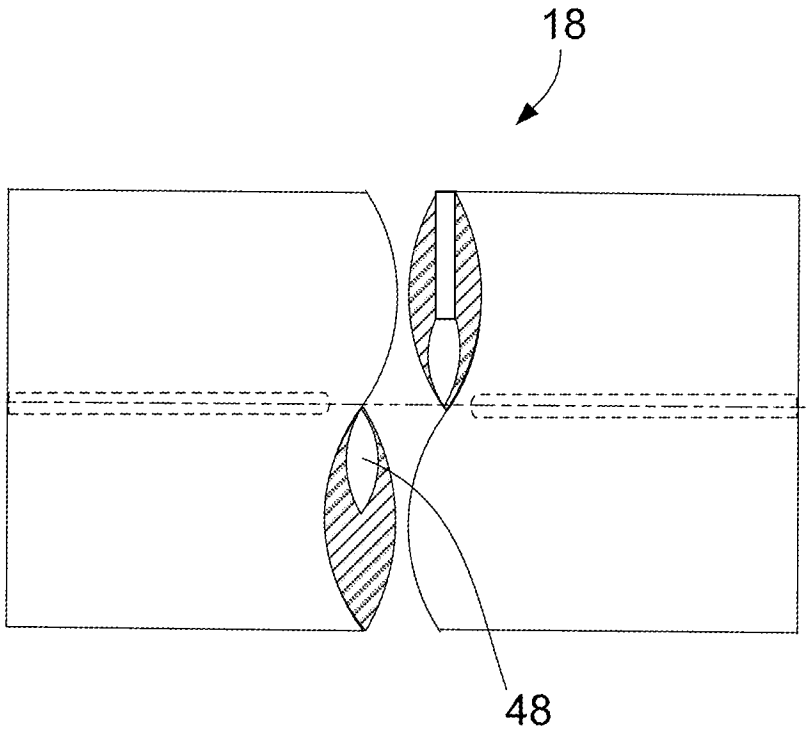
FIG. 3 is a side elevational view of a pump float of the liquid level control pump of FIG. 1.

Referring to FIG. 3, float 18 includes a through bore 48 which is sized to slidably contact the outer wall of discharge tube 16. According to several aspects, the material of float 18 is selected as a polymeric material to provide the upward force required for displacement of control rod 20.

Figure 4:
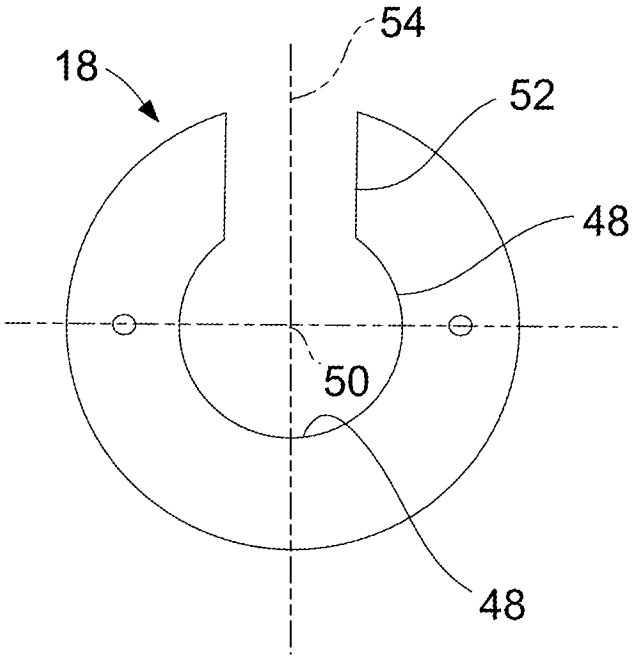
FIG. 4 is an end elevational view of the pump float of FIG. 3.

Referring to FIG. 4 and again to FIG. 3, the through bore 48 of float 18 is centered with respect to a float longitudinal axis 50. To minimize the frictional contact between control rod 20 and material of float 18, a through slot 52 is provided, which extends all the way from an outer wall of the float 18 into the through bore 48. The open design of through slot 52 allows free flow of the liquid of landfill well pipe 14 entirely about the perimeter of control rod 20 for the entire upward and downward displacement of float 18. Clearance is also provided by a width of the through slot 52 which is sized to be approximately two times a diameter of control rod 20. This further minimizes the potential for buildup of materials present in the liquid from plating out onto control rod 20 or the surfaces of float 18, which would increase the frictional resistance to displacement of float 18. It is noted that through slot 52 is aligned with a slot center axis 54 intersecting with the float longitudinal axis 50.

Referring to FIG. 5 and again to FIGS. 1 and 2, each of the first and second float end caps 22, 24 are identical to each other and are installed in oppositely facing directions on the pump casing 12. Each of the first and second float end caps 22, 24 includes a cap body 56 which is washer-like in appearance having a center bore 58. According to several aspects, a plurality of raised bumpers 60, each defining a semi-spherical shape, extend inwardly from a bore inner wall 62 of center bore 58. Each of the raised bumpers 60 are provided to make direct contact with the outer wall of discharge tube 16. The rounded geometry of the raised bumpers 60, as well as the use of a minimum quantity of the raised bumpers 60 (according to several aspects four raised bumpers 60 may be provided), minimizes frictional contact with the discharge tube 16. In addition, a material selected for each of the first and second float end caps 22, 24 is a PEEK polymeric material selected due to its low-friction properties and resistance to the materials present in landfill well liquids. Other engineering plastics in addition to PEEK material, such as improved polyamides (nylons) and glass fiber reinforced polyphenylene sulfide (PPS)0 can also be used, each having desirable characteristics for the float end caps such as strength, chemical resistance and wear/abrasion resistance. A control rod receiving aperture 64 is created through cap body 56, which closely matches an outer diameter of control rod 20, allowing for sliding contact between the first and second float end caps 22, 24 and control rod 20 as the float 18 displaces.

Referring to FIG. 6 and again to FIGS. 1-2 and 5, a bumper inner diameter 66 is defined by an innermost rounded surface 68 of each of the multiple raised bumpers 60. The bumper inner diameter 66 is substantially equal to or larger than a diameter of the discharge tube 16. According to several aspects, the four raised bumpers 60*a*, 60*b*, 60*c*, 60*d* are each located at approximately 90-degree intervals with respect to each other with one of the raised bumpers 60*b* also axially aligned with control rod receiving aperture 64. In addition to control rod receiving aperture 64, first and second fastener apertures 70, 72 are also created through the cap body 56. The first and second fastener apertures 70, 72 provide for fastener installation of the first or second float end caps 22, 24 at their respective end positions on float 18.

Referring to FIG. 7 and again to FIGS. 5-6, a chamfered edge 74 can be provided with each of the first and second fastener apertures 70, 72. Chamfered edge 74 allows for full recession of a fastener head (not shown) used for installation of the first or second float end caps 22, 24.

Referring to FIG. 8 and again to FIGS. 5-7, the geometry of control rod receiving aperture 64 aligns a central axis 65 of the control rod receiving aperture 64 substantially parallel with respect to a central axis 67 of the first and second float end caps 22, 24.

Referring to FIG. 9 and again to FIGS. 1 and 2, the pivoting lever assembly 30 is modified in the design of liquid level control pump 10 to reduce the quantity of parts associated with operation of poppets that control the flow of pressurized air into and out of pump casing 12. The pivoting lever assembly 30 includes each of a first and a second lever half 76, 78, each having a first and second connecting flange 80, 82 oppositely extending therefrom. A planar end face 84 is created on each of the first and second connecting flanges 80, 82 which abut with the corresponding faces of the opposite half of the pivoting lever assembly 30. A slot 86 is created between the first and second connecting flanges 80, 82, which provides for the positioning of an insert member 88 which is located substantially at a central position of slot 86. An elongated slot 90 is provided in each of the first and second lever halves 76, 78 to allow for liquid flow past the pivoting lever assembly 30.

A poppet 92 having a needle end 94 is positioned within at least one of the slots 86. The needle end 94 can be used, for example, to isolate the flow of pressurized air into pump casing 12 from the pressurized air supply tube 32 when the float 18 is not in direct contact with upper float stop 28. The poppet 92 is connected to one of the first or second lever halves 76, 78 using a lever poppet bushing 96 having a bushing rod 98 extending therefrom. The bushing rod 98 is sized to be slidably received through a poppet aperture 100 of poppet 92 and thereafter received in a rod receiving aperture 102 of the insert member 88, such as insert member 88' (shown).

Figure 9:
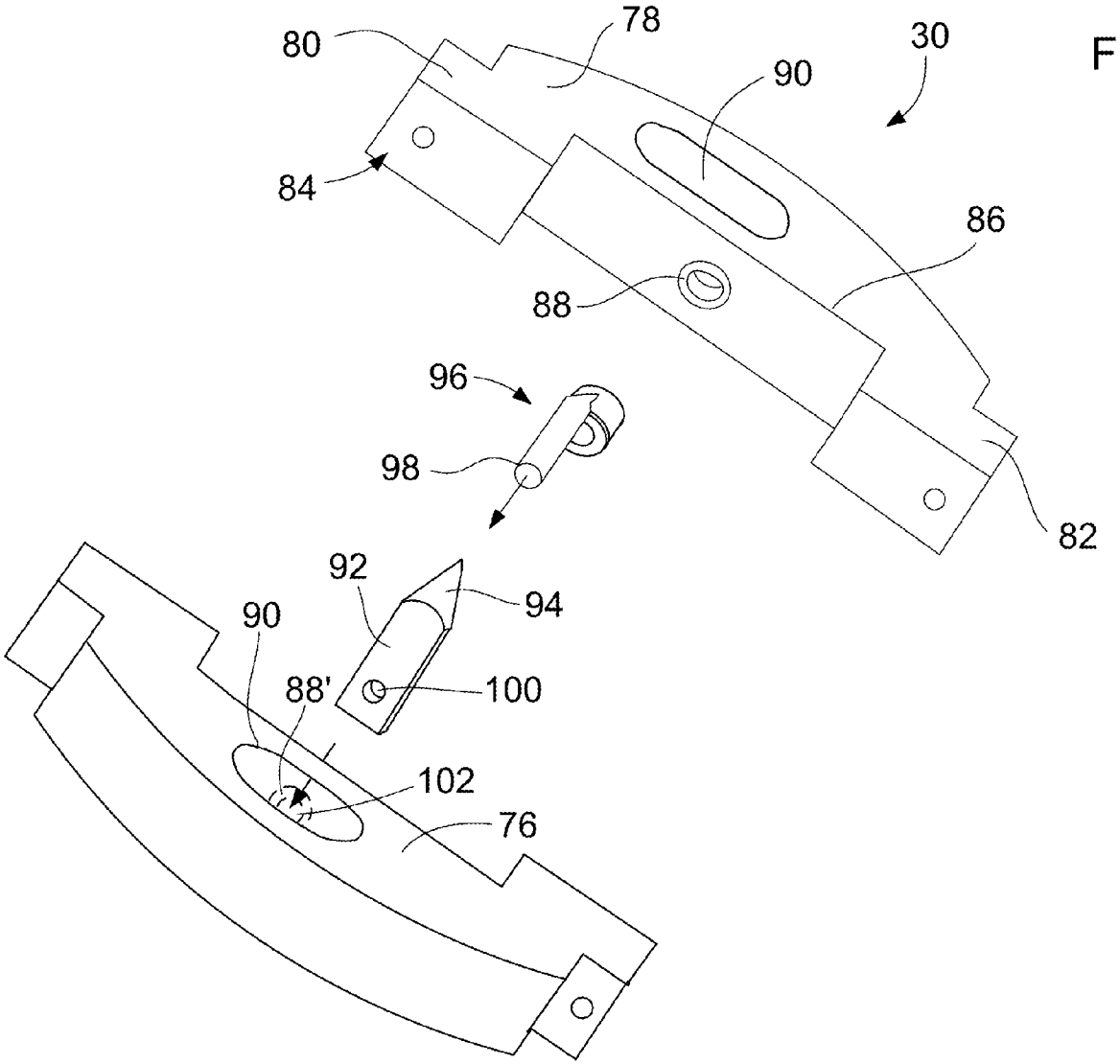
FIG. 9 is a perspective assembly view of a pivoting lever assembly of the liquid level control pump of FIG. 1.

Referring to FIG. 10 and again to FIG. 9, each of the first and second lever halves 76, 78 includes an insert aperture 104 which extends inwardly (away) from an end face of slot 86. An insert outer wall 106 of the insert member 88 is sized to be frictionally coupled against the insert aperture 104 such that a friction fit will retain the insert member 88 within one of the first or second lever halves 76, 78.

Figure 10:
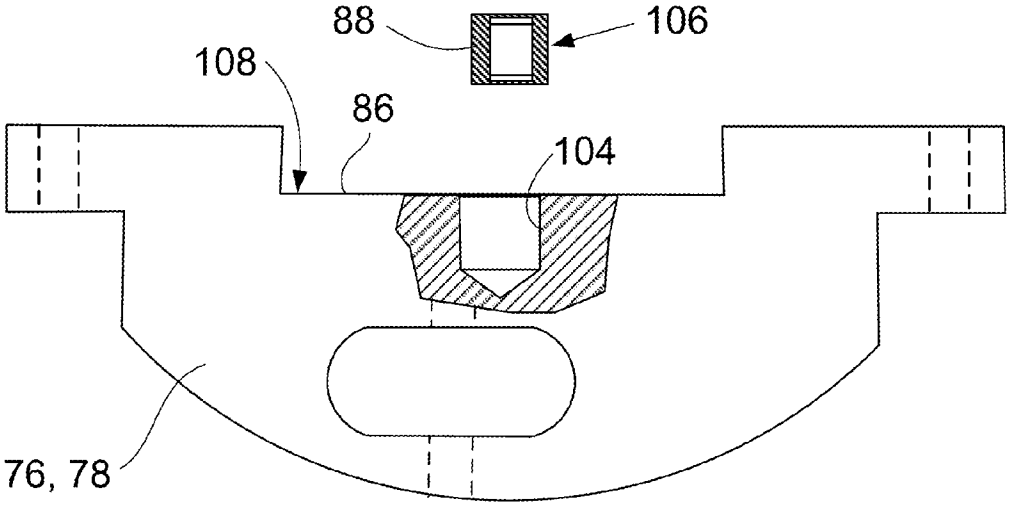
FIG. 10 is a partial cross sectional front elevational view of a pivoting lever portion of the pivoting lever assembly of FIG. 9.

Referring to FIG. 11 and again to FIG. 10, after insertion of the insert member 88 into the insert aperture 104, an end face of the insert member 88 is positioned substantially flush with a slot end wall 108 of the slot 86.

Figure 11:
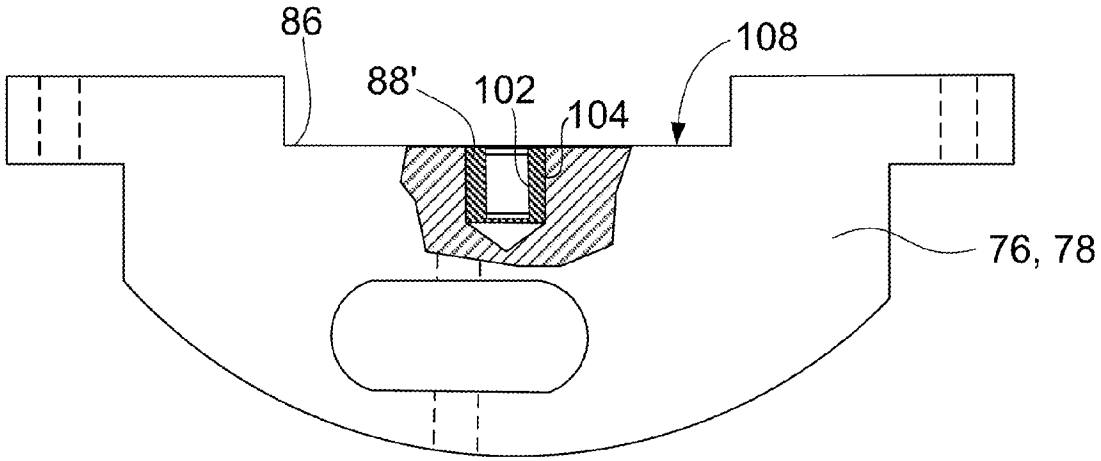
FIG. 11 is a partial cross sectional front elevational view of the pivoting lever portion of FIG. 10.

Referring to FIG. 12 and again to FIGS. 9-11, the lever poppet bushing 96 includes the bushing rod 98 which is integrally connected to a bushing sleeve 110. A through aperture 111 created through the bushing sleeve 110 is oriented axially parallel with respect to a longitudinal axis of the bushing rod 98. For maximum wear life, the material of lever poppet bushing 96 can be a nitride material.

Figure 13:
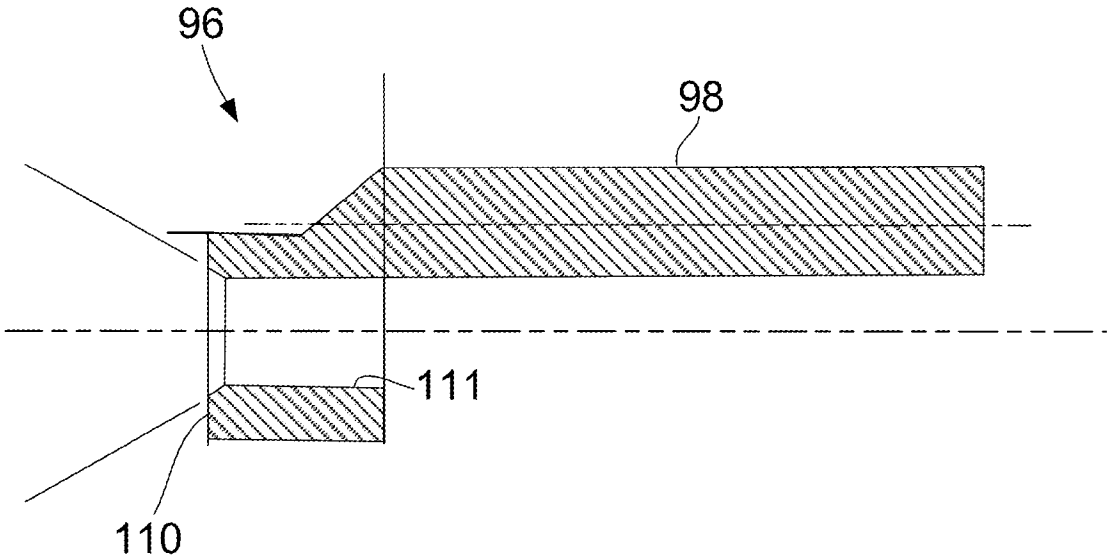
FIG. 13 is a cross sectional view taken at section 13 of FIG. 12.
Figure 12:
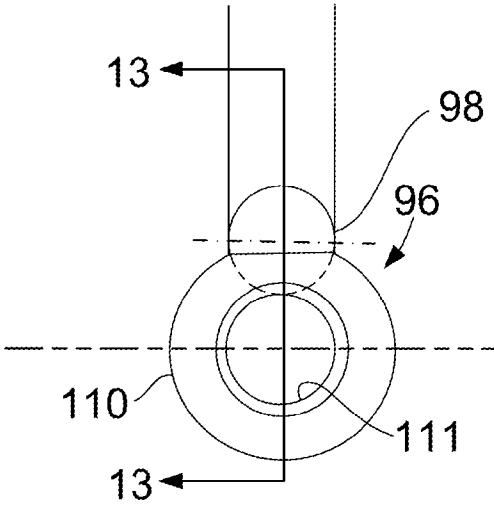
FIG. 12 is an end elevational view of a lever poppet bushing of the present disclosure.

Referring to FIG. 13 and again to FIG. 12, the bushing sleeve 110 can be created as a separate part with respect to bushing rod 98 and the two parts fixed together, for example, by welding, adhesive or molding. According to other aspects, the bushing rod 98 and the bushing sleeve 110 can be integrally provided of a single material by machining the geometry of lever poppet bushing 96. According to several aspects, an inner bore wall of the through aperture 111 extending through bushing sleeve 110 is aligned coplanar with a lower outer surface of the bushing rod 98.

Referring to FIG. 14 and again to FIGS. 1-2, the housing adapter 40 includes a hex head 112 to provide for tool use during installation of the housing adapter onto pump casing 12. Housing adapter 40 further includes a male threaded shank 114 from which a blade member 116 integrally extends beyond a shank end face 118 at the end of threaded shank 114. A tubing connection head 120 is provided at an opposite end with respect to threaded shank 114 to provide for connection of a discharge tube or pipe to discharge fluid during operation of liquid level control pump 10.

Figure 14:
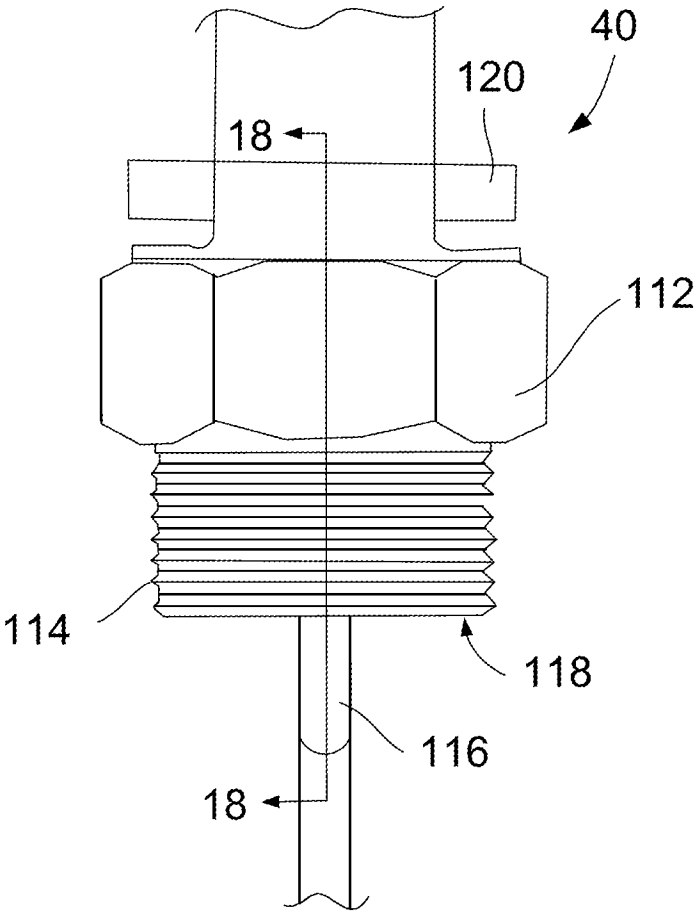
FIG. 14 is a front elevational view of a housing adapter of the present disclosure.

Referring to FIG. 15 and again to FIG. 14, housing adapter 40 includes a housing bore 122 which is substantially bisected by the blade member 116. This creates a first and a second bore portion 124, 126 of substantially equal size on opposite sides of the blade member 116. The blade member 116 therefore results in minimal restriction of fluid flow through the housing bore 122.

Figure 15:
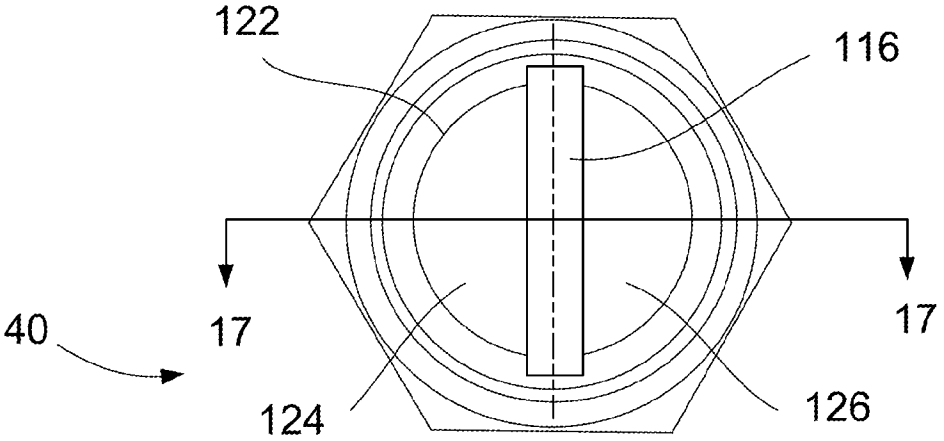
FIG. 15 is a bottom plan view of the housing adapter of FIG. 14.

Referring to FIG. 16 and again to FIGS. 14-15, each of the hex head 112, tubing connection head 120, and the housing bore 122 are coaxially aligned with respect to a longitudinal axis of housing adapter 40.

Figure 16:
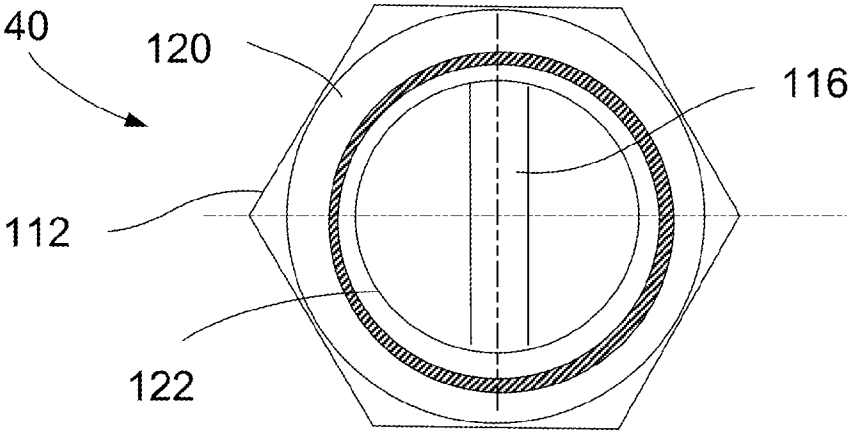
FIG. 16 is a top plan view of the housing adapter of FIG. 14.
Figure 17:
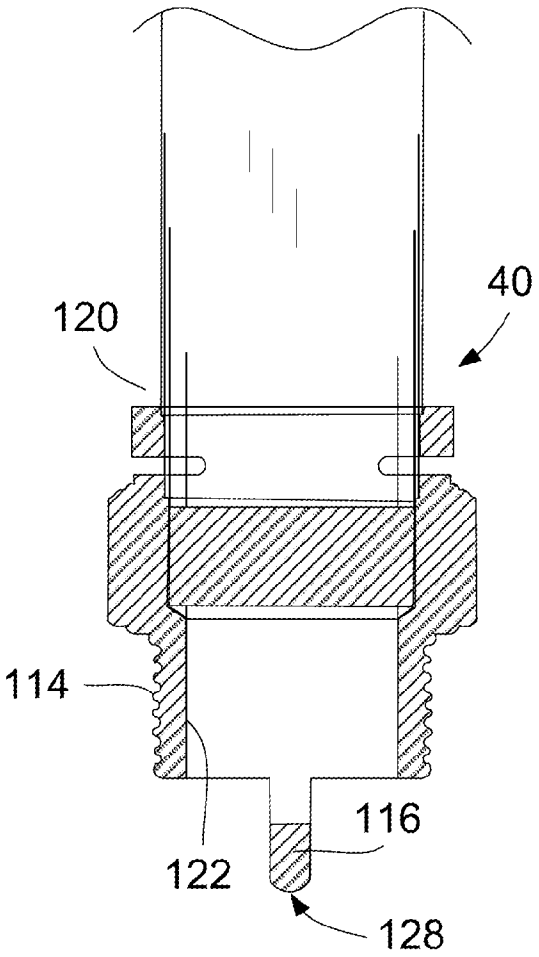
FIG. 17 is a front cross sectional view taken at section 17 of FIG. 15.

Referring to FIG. 17 and again to FIGS. 14-16, the blade member 116 has a free end defined as a rounded end 128 having, for example, a semispherical shape. Rounded end 128 is provided to minimize the surface area of blade member 116, which is in direct contact with ball 34 when ball 34 raises to allow discharge of fluid from liquid level control pump 10. Rounded end 128 increases the service life of ball 34, while preventing ball 34 from discharging via the housing bore 122 through the discharge pipe. The blade member 116 therefore minimizes fluid flow resistance through the housing bore 122 while simultaneously retaining ball 34.

Figure 18:
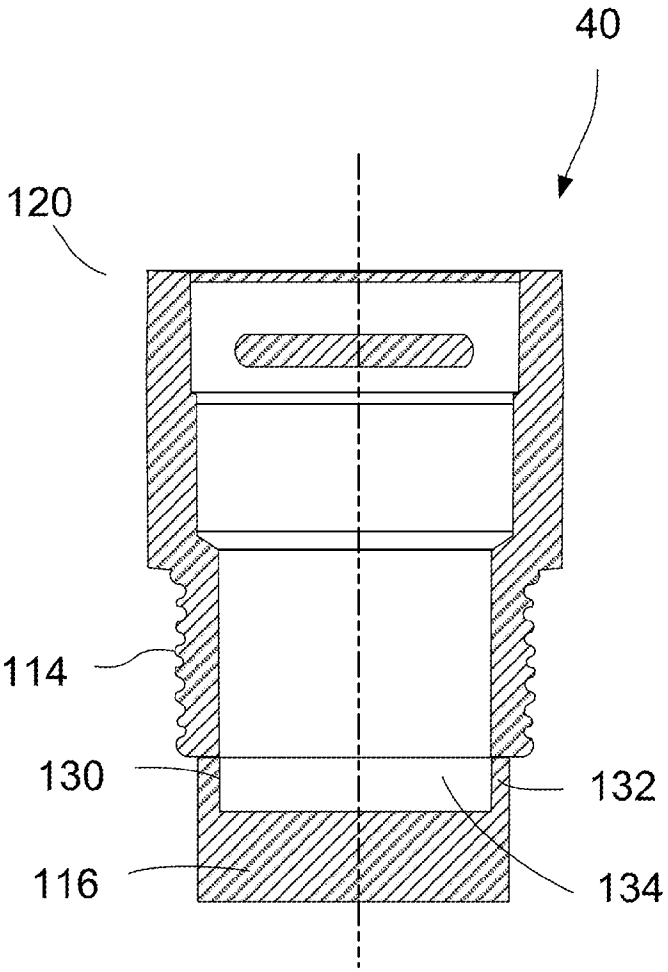
FIG. 18 is a rear cross sectional view taken at section 18 of FIG. 14.

Referring to FIG. 18 and again to FIGS. 14-17, the blade member 116 is an integral extension of the material of housing adapter 40 outward of the threaded shank 114. A first and a second blade support leg 130, 132 integrally connect the blade member 116 to housing adapter 40. This extension created by the first and second blade support legs 130, 132 also creates a flow window 134 above the blade member 116, as viewed in reference to FIG. 18. Flow window 134 also helps reduce fluid flow resistance through housing adapter 40.

Figure 19:
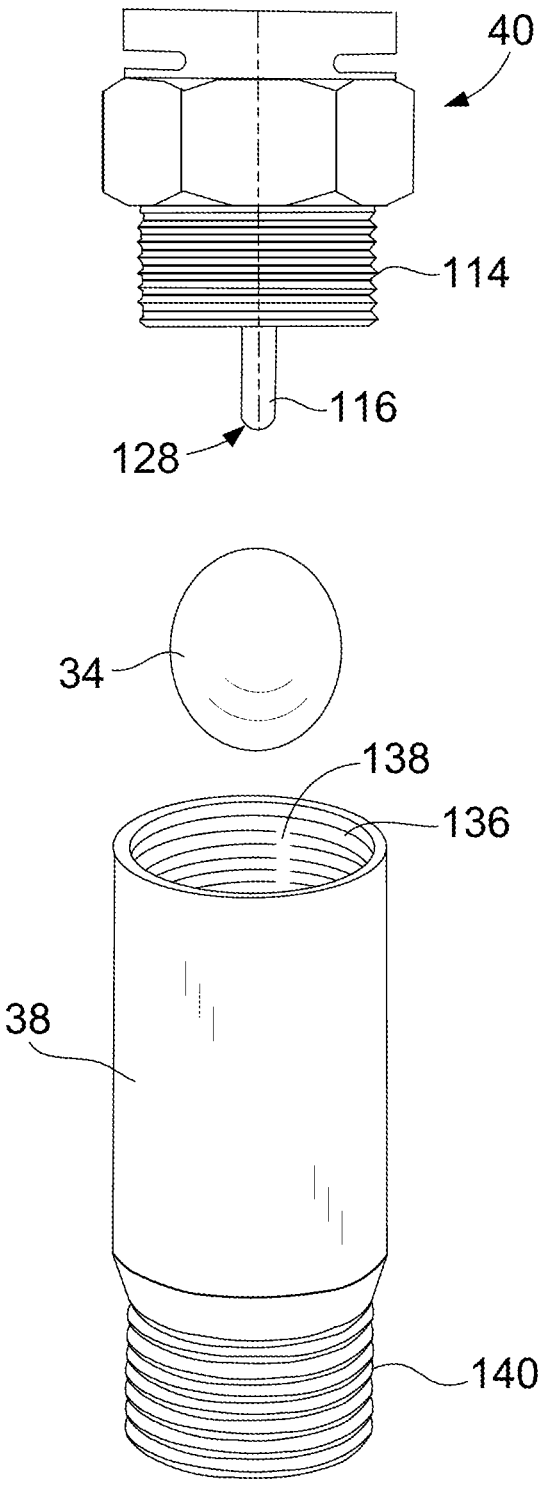
FIG. 19 is an assembly view of a ball check valve and housing adapter of the present disclosure.

Referring to FIG. 19 and again to FIGS. 1-2 and 14-18, the housing adapter 40 is assembled into the check valve ball housing 38 by threaded insertion of the threaded shank 114 engaging internal threads 136 created in a ball receiving bore 138 of check valve ball housing 38. The ball 34 is positioned within the ball receiving bore 138 prior to installation of housing adapter 40 such that the blade member 116 prevents release of ball 34. As previously noted, the rounded end 128 of blade member 116 is provided to minimize the surface area of blade member 116 in direct contact when ball 34 is positioned at its maximum lift location. The check valve ball housing 38 is itself threadably engaged to the pump casing 12 using a housing male thread 140.

The PEEK (polyether ether ketone) plastic, bearing grade float end caps 22, 24 are designed to reduce scraping damage to the surface finish of the pump discharge tube 16, whether the discharge tube 16 is coated or not. The PEEK end caps 22, 24 have rounded bumpers 60 extending inwardly from the bore inner wall 62 directed toward the central axis 67 of the end caps 22, 24. The bumpers 60 minimize a surface area of the end caps 22, 24 in direct contact with the discharge tube 16, and thereby help reduce abrasion of the discharge tube surface. This abrasion if not minimized can lead to corrosion and pitting of the discharge tube 16 which in turn can aid in solids adhesion.

The pivoting lever assembly 30 on the air control mechanism eliminates the stainless steel "E" clips currently in use for this purpose. The present disclosure pivoting lever assembly 30 design has fewer parts, is easier to assemble and can be retrofitted in the field to existing pumps.

The float 18 is provided having the open channel 52 for the control rod 20 to pass-through, rather than the current enclosed channel. The open channel 52 reduces the build-up of solids vs. with the conventional bore design, is easier to clean and makes coatings easier to apply.

The float 18 is coated to reduce the adhesion of solids and make them easier to clean off. An epoxy silicone paint is applied to the float 18 which has been found to be effective in reducing adhesion of solids.

An improved finish is also provided for the discharge tube 16 to reduce solids adhesion, make cleaning easier and reduce corrosion. The improved surface finish uses centerless grinding followed by electro-polishing for a mirror-bright finish.

Referring now to FIGS. 20-24, in another embodiment the liquid level control pump 10 may incorporate a discharge tube sleeve (hereinafter simply "sleeve") 150. The sleeve 150 forms a tubular component designed to fit over the discharge tube 16 (FIGS. 1 and 2). The sleeve 150 forms a component that may be easily replaced simply by sliding it off from the discharge tube 16 and sliding a new sleeve 150 on over the discharge tube 16. By incorporating the sleeve 150 and making it readily replaceable, the situation where a buildup of solids on the exterior of the discharge tube 16 might occur can be avoided. Such a condition could impede the smooth, easy sliding motion of the float 18 up and down the discharge tube 16 and potentially cause the float 18 to "hang up" at some intermediate point along its intended path of travel. The sleeve 150 may have a length that extends virtually the entire length of the discharge tube 16, or a length which is at least sufficiently long to cover that portion of the discharge tube 16 that the float 18 rides along during normal operation of the pump 10. The sleeve 150 thus functions to provide an exceptionally smooth, low friction surface for the inner surface of the float 18 to ride on. The sleeve 150 may be formed from a bearing grade thermoplastic polymer, for example, but not limited to, polyether ether ketone (PEEK) or Polyphenylene Sulfide (PPS). Other materials such as graphite and/or other lubricants may also be incorporated into its material composition to further reduce friction and/or to help reduce the likelihood of solids buildup on the external surface of the sleeve 150.

An end view of the sleeve 150 is shown in FIG. 21. The sleeve 150 may be extruded or formed in any other suitable manner. An inner wall 152 of the sleeve 150 may include a plurality of circumferentially spaced apart teeth or ridges 154. Preferably the ridges 154 are spaced evenly about the entire circumference of the inner wall 152 of the sleeve 150. FIG. 21 shows the ridges 154 spaced about every 30 degrees around the inner wall 152, but it will be appreciated that a greater or lesser number of ridges 154 may be used, and either a uniform spacing or non-uniform spacing of the ridges 154 can be used. The ridges 154 in this example project about 0.023 inch radially inward, as indicated by dimensional arrows 153 in FIG. 22, but again, this dimension could vary significantly. In one example the wall thickness of sleeve 150 is between about 0.030 inch to about 0.060 inch. An inner diameter formed by the ridges 154, as indicated by dimensional arrow 156 in FIG. 21, is preferably just slightly less, for example by 0.010 inch or so, than the outer diameter of the discharge tube 16. The ridges 154 may bend or deflect slightly as the sleeve 150 is slid onto the discharge tube 16 during assembly of the pump 10, and thus help to take up the play between the discharge tube 16 and the sleeve 150 and help to maintain the sleeve 150 axially centered about the discharge tube 16. The outer surface of the discharge tube 16 may also be highly polished to further help resist the buildup of solids thereon. Since the sleeve 150 can be quickly and easily slid on and off the discharge tube 16, this enables convenient periodic replacement of the sleeve 150 without the need for any special tools or disassembly procedures. It is anticipated that users will find that replacement of the sleeve 150 with a new sleeve may even be easily accomplished in the field. Users may find that establishing a schedule for periodic replacement of the sleeve 150 (e.g., once 6-12 months) may help to ensure that no tangible buildup of solids occurs during use of the pump 10.

Figure 23:
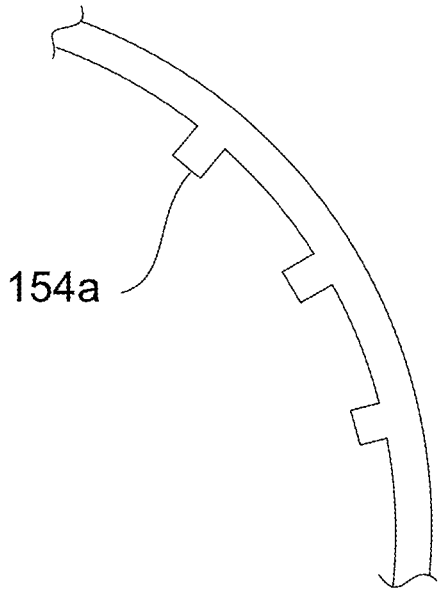
FIG. 23 shows an example of the ridges of the sleeve having a rectangular shape.
Figure 24:
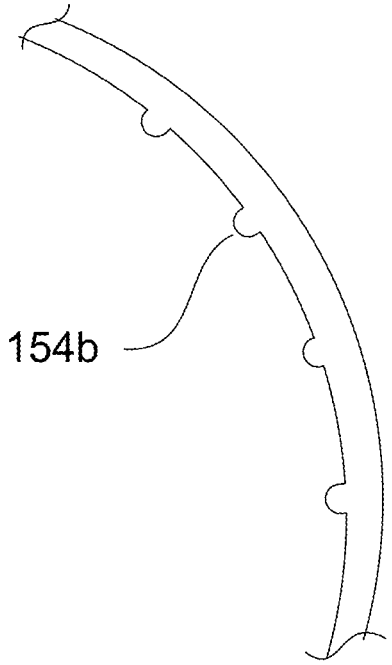
FIG. 24 shows an example of the ridges of the sleeve having a semi-circular shape.

FIGS. 23 and 24 show alternative forms of the ridges 154. The ridges 154*a* in FIG. 23 are shown as being generally square shaped. The ridges 154*b* in FIG. 24 are shown as having a rounded, arcuate shape. In both cases the ridges 154*a* and 154*b* are able to flex or deform slightly as the sleeve 150 is inserted onto the discharge tube 16 to eliminate play between the sleeve 154 and the discharge tube 16.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A liquid level control pump adapted to be lowered into contact with a fluid collecting with a wellbore, and being in communication with an external pressurized fluid source, the liquid level control pump comprising:

a pump casing;

a discharge tube disposed substantially within the pump casing and having a first end and a second end, the discharge tube operable to receive fluid collecting within an area between the pump casing and an outer surface of the discharge tube, the discharge tube further including first and second ends;

a first check valve disposed at the first end for controlling a flow of the fluid within the discharge tube to one direction only, out from the first end of the discharge tube;

a second check valve disposed at the second end for limiting the flow of fluid to one direction only, into the pump casing;

the source of pressurized fluid being in communication with the pump casing;

a float arranged coaxially around the discharge tube and movable along the discharge tube toward the first and second ends;

a control rod disposed adjacent the discharge tube and operably associated with the float so as to be lifted by the float as the float moves toward the first end as the area within the pump casing fills with the fluid, and then moves towards the second end as the fluid within the pump casing is pumped out through the discharge tube using a pressurized fluid from the pressurized fluid source;

a pivoting lever assembly operably associated with the float for controlling the application and interruption of the pressurized fluid into the pump casing, to thus control the pumping of the fluid collecting within the pump casing out from the pump casing and into the second end of the discharge tube, towards the first end of the discharge tube; and wherein the float includes a through bore and a through slot in communication with the through bore, the through slot permitting passage of a portion of the control rod therethrough and operating to permit fluid flow about an entire periphery of the control rod as the float moves up and down adjacent an outer surface of the discharge tube, and relative to the control rod, thus reducing or eliminating a buildup of solids between the control rod and the float that could otherwise affect free sliding movement of the float along the discharge tube.

2. The liquid level control pump of claim 1, wherein the float includes first and second float end caps secured at opposite longitudinal ends of the float, each of the first and second float end caps including a center bore.

3. The liquid level control pump of claim 2, wherein a wall surface defining the center bore of at least one of the first and second float end caps includes a plurality of raised bumpers spaced circumferentially around the center bore, and projecting radially inwardly toward an axial center of the centerbore;

the raised bumpers further defining a circular opening of a diameter just slightly larger than an outer diameter of the discharge tube and adapted to make contact with the outer surface of the discharge tube in a manner that minimizes frictional contact with the outer surface of the discharge tube as the float moves up and down along the discharge tube.

4. The liquid level control pump of claim 3, wherein the raised bumpers each have a rounded, semi-spherical shape.

5. The liquid level control pump of claim 3, wherein four of the raised bumpers are spaced at about 90 degree intervals around the wall surface which defines the centerbore.

6. The liquid level control pump of claim 1, wherein the pivoting lever assembly includes:

first and second lever halves;

the first and second lever halves being pivotally connected to the control rod such that the first and second lever halves are able to move pivotally relative to the control rod as the float moves the control rod linearly;

a bushing secured between the first and second lever halves and extending perpendicularly therebetween;

a poppet having an aperture for receiving a portion of the bushing, and a needle end adapted block the flow of pressurized air into the pump casing until the float rises to a predetermined position of travel when the pump casing is filling with fluid.

7. The liquid level control pump of claim 1, wherein the first check valve includes a check valve ball housing and a check ball disposed therein, and the liquid level control apparatus further comprises:

a housing adaptor having a housing bore and a threaded portion adapted to be threadably secured to the check valve ball housing;

the housing adaptor including a blade member projecting therefrom for engaging the check ball and preventing the check ball from closing off the housing bore when fluid is being pumped up through the discharge tube.

8. The liquid level control pump of claim 7, wherein the blade member is spaced apart from the threaded portion of the housing adaptor by a pair of support legs extending outwardly from the threaded portion, and bisects the housing bore.

9. The liquid level control pump of claim 7, wherein the blade member includes a rounded end surface which minimizes a surface area of the blade member when the blade member contacts the check ball, while still enabling the blade member to prevent the check ball from blocking off the housing bore.

10. The liquid level control pump of claim 1, wherein the float is coated with an epoxy silicone paint to help reduce an adhesion of solids to the float.

11. The liquid level control pump of claim 1, further comprising a readily removable and replaceable discharge tube sleeve positioned over at least a portion of the discharge tube, the discharge tube sleeve providing a smooth, low friction surface upon which the float moves slidably there along.

12. The liquid level control pump of claim 11, wherein the discharge tube sleeve is comprised of a bearing grade thermoplastic polymer.

13. The liquid level control pump of claim 11, wherein the discharge tube sleeve includes an inner wall having a plurality of circumferentially spaced apart ridges or teeth which contact the outer surface of the discharge tube to help maintain the discharge tube sleeve axially centered on the discharge tube.

14. The liquid level control pump of claim 13, wherein a diameter formed by the ridges or teeth is just slightly smaller than an outer diameter of the discharge tube, such that the ridges or teeth make frictional contact with the outer surface of the discharge tube when the discharge tube sleeve is slid onto the discharge tube.

15. The liquid level control pump of claim 13, wherein the ridges or teeth are adapted to bend or deflect slightly as the discharge tube sleeve is slid onto the discharge tube, to further help take up play between the discharge tube sleeve and the discharge tube.

16. The liquid level control pump of claim 13, wherein the ridges or teeth have at least one of:

a pointed shape;

a square shape; or a rounded shape.

17. A liquid level control pump adapted to be lowered into contact with a fluid collecting with a wellbore, and in communication with an external pressurized fluid source, the liquid level control pump comprising:

a pump casing;

a discharge tube disposed substantially within the pump casing and having a first end and a second end, the discharge tube operable to receive fluid collecting within an area between the pump casing and an outer surface of the discharge tube, the discharge tube further including first and second ends;

a first check valve disposed at the first end for controlling a flow of the fluid within the discharge tube to one direction only, out from the first end of the discharge tube;

a second check valve disposed at the second end for limiting the flow of fluid to one direction only, from the pump casing into the discharge tube at the second end;

the source of pressurized fluid being in communication with the pump casing;

a float arranged coaxially around the discharge tube and movable parallel to the discharge tube towards and away from the first and second ends;

a control rod disposed adjacent the discharge tube and operably associated with the float so as to be lifted by the float as the float moves toward the first end as the area within the pump casing fills with the fluid, and then moves towards the second end as the fluid within the pump casing is pumped out through the discharge tube using a pressurized fluid from the pressurized fluid source;

a pivoting lever assembly operably associated with the float for controlling the application and interruption of the pressurized fluid into the pump casing, to thus control the pumping of the fluid collecting within the pump casing out from the pump casing and into the second end of the discharge tube, towards the first end of the discharge tube; and a removable and replaceable discharge tube sleeve disposed over the outer surface of the discharge tube, the float adapted to move slidably along an outer surface of the discharge tube sleeve.

18. The liquid level control pump of claim 17, wherein the removable and replaceable discharge tube sleeve includes a plurality of teeth or ridges on an inner surface thereof for frictionally engaging the outer surface of the discharge tube.

19. The liquid level control pump of claim 17, wherein the float comprises:

a through bore formed at an axial center of the float; and a through slot communicating with the through bore for allowing passage of the control rod through the float.

20. The liquid level control pump of claim 17, wherein the first check valve includes a check valve ball housing and a check ball disposed therein, and the liquid level control pump further comprises:

a housing adaptor having a housing bore and a threaded portion adapted to be threadably secured to the check valve ball housing;

the housing adaptor including a blade member projecting therefrom for engaging the check ball and preventing the check ball from closing off the housing bore when fluid is being pumped up through the discharge tube and out through the first end of the discharge tube; and wherein the blade member is spaced apart from the threaded portion of the housing adaptor by a pair of support legs extending outwardly from the threaded portion, and bisects the housing bore.

* * * * *